US011011868B2

(12) United States Patent
Miyamoto

(10) Patent No.: US 11,011,868 B2
(45) Date of Patent: May 18, 2021

(54) OPENING SEALING MEMBER AND ELECTRICAL DEVICE

(71) Applicant: Sumitomo Wiring Systems, Ltd., Mie (JP)

(72) Inventor: Takeru Miyamoto, Mie (JP)

(73) Assignee: Sumitomo Wiring Systems, Ltd.

( * ) Notice: Subject to any disclaimer, the term of this patent is extended or adjusted under 35 U.S.C. 154(b) by 52 days.

(21) Appl. No.: 16/603,215

(22) PCT Filed: Apr. 2, 2018

(86) PCT No.: PCT/JP2018/014069
§ 371 (c)(1),
(2) Date: Oct. 4, 2019

(87) PCT Pub. No.: WO2018/186330
PCT Pub. Date: Oct. 11, 2018

(65) Prior Publication Data

US 2021/0083420 A1 Mar. 18, 2021

(30) Foreign Application Priority Data

Apr. 7, 2017 (JP) ..... JP2017-076928

(51) Int. Cl.
*H01R 13/512* (2006.01)
*H01R 13/52* (2006.01)

(52) U.S. Cl.
CPC ..... *H01R 13/5213* (2013.01); *H01R 13/512* (2013.01); *H01R 13/5202* (2013.01); *H01R 13/5227* (2013.01); *H01R 2201/26* (2013.01)

(58) Field of Classification Search
CPC ..... H01R 13/5213; H01R 13/512; H01R 13/5202; H01R 13/5227; H01R 2201/26
See application file for complete search history.

(56) References Cited

U.S. PATENT DOCUMENTS 4,793,819 A * 12/1988 Berg ..... H01R 13/5227 174/67
6,056,592 A 5/2000 Hashizawa et al.
(Continued)

FOREIGN PATENT DOCUMENTS

JP 11-126661 5/1999
JP 2012-236450 12/2012
(Continued)

OTHER PUBLICATIONS

International Search Report dated May 29, 2018.

*Primary Examiner* — Tho D Ta
(74) *Attorney, Agent, or Firm* — Gerald E. Hespos; Michael J. Porco; Matthew T. Hespos

(57) ABSTRACT

An opening sealing member 10 is for closing an opening 91 for work open in a vertical direction and includes a cover plate 20 configured to cover the opening 91 from above and a plug body 40 held on the cover plate 20 and including a sealing member 45 to be held in close contact with an inner peripheral surface of the opening 91 by the plug body being fit into the opening 91. An upper surface 21A of the cover plate 20 is provided with a gradient to cause water adhering to the cover plate 20 to flow down to outside of the cover plate 20. An upper surface 51A of the plug body 40 is provided with a gradient to cause water adhering to the upper surface 51A of the plug body 40 to flow down to outside of the opening 91.

4 Claims, 7 Drawing Sheets

(56) References Cited

U.S. PATENT DOCUMENTS

| | | | | |
|---|---|---|---|---|
| 6,319,057 | B2 * | 11/2001 | Sekido | H01H 85/2045<br>439/190 |
| 2005/0178576 | A1 * | 8/2005 | Saka | H01R 13/5227<br>174/66 |
| 2005/0227542 | A1 * | 10/2005 | Fukushima | H01R 13/5227<br>439/620.27 |
| 2011/0297133 | A1 * | 12/2011 | Nakao | H01F 38/12<br>123/635 |
| 2012/0285097 | A1 | 11/2012 | Sakakura | |
| 2013/0189879 | A1 | 7/2013 | Kondo | |
| 2014/0113489 | A1 | 4/2014 | Tanaka et al. | |

FOREIGN PATENT DOCUMENTS

| | | |
|---|---|---|
| JP | 2013-026078 | 2/2013 |
| JP | 2013-149481 | 8/2013 |

* cited by examiner

OPENING SEALING MEMBER AND ELECTRICAL DEVICE

TECHNICAL FIELD

The present invention relates to an opening sealing member for sealing an opening for work and an electrical device using this opening sealing member.

BACKGROUND ART

A terminal block for connection to an external circuit is provided inside a case of an electrical device installed in an automotive vehicle or the like and the case is provided with an opening for work to perform an operation of connecting this terminal block and the external circuit. This opening is closed by a sealing cover (opening sealing member) when the operation is not performed. A sealing cover disclosed in Japanese Unexamined Patent Publication No. 2012-236450 (patent literature 1 below) is known as an example of such a sealing cover.

This sealing cover includes a sealing ring holding member made of synthetic resin and having a sealing ring to be fit into an opening provided in a metal case accommodating an electrical device and held in close contact with the inner peripheral surface of the opening fit on an outer peripheral surface, and a cover body made of metal and mounted on a surface of the case. A shaft portion provided in the sealing ring holding member is inserted into an insertion hole provided in the cover body and bolted together with a retaining means, whereby the cover body and the sealing ring holding member are fixed.

CITATION LIST

Patent Literature

Patent Literature 1: Japanese Unexamined Patent Publication No. 2012-236450

SUMMARY OF INVENTION

Technical Problem

However, in the configuration of Japanese Unexamined Patent Publication No. 2012-236450 (patent literature 1 above), water intrudes into a gap between the cover body and the sealing ring holding member since the insertion hole is open in the cover body. If this water stays without being discharged, the cover body and the like made of metal may be corroded.

Solution to Problem

An opening sealing member disclosed in this specification is an opening sealing member for closing an opening for work open in a vertical direction, the opening sealing member including a cover plate configured to cover the opening from above, and a plug body held on the cover plate and including a sealing member to be held in close contact with an inner peripheral surface of the opening by the plug body being fit into the opening, wherein an upper surface of the cover plate is provided with a gradient to cause water adhering to the cover plate to flow down to outside of the cover plate, and an upper surface of the plug body is provided with a gradient to cause water adhering to the upper surface of the plug body to flow down to outside of the opening.

Water splashed on the cover plate flows down from the cover plate and does not stay on the cover plate since the upper surface of the cover plate is provided with the gradient. Further, water intruding between the cover plate and the plug body also flows down from the plug body to the outside of the opening since the plug body is provided with the gradient. Thus, the water does not stay between the plug body and the cover plate. Therefore, corrosion by the intruding water can be suppressed.

The following configurations may be adopted as embodiments of the opening sealing member disclosed in this specification.

The upper surface of the cover plate and the upper surface of the plug body may be provided with the gradients in the same direction.

Since the water on the cover plate and the intruding water between the plug body and the cover plate flow down in the same direction, the flowing-down water can be easily dealt with.

A boss portion used to screw a bolt for fixing the plug body to the cover plate may be provided to project on the plug body, the plug body may have an elliptical shape in a plan view and the upper surface of the plug body may be provided with a first plug body gradient in a longitudinal direction and a second plug body gradient in a transverse direction, and a lower end position of the first plug body gradient may be shifted in the longitudinal direction from a position where the boss portion is provided.

Since the boss portion is provided to project on the plug body, the boss portion may stand as a hindrance in discharging water. However, since the lower end position of the first plug body gradient provided on the upper surface of the plug body is shifted in the longitudinal direction from the position where the boss portion is provided, it can be suppressed that water stays on a peripheral edge of the boss portion.

Further, an electrical device using the opening sealing member disclosed in this specification may be configured as follows.

The electrical device includes an opening sealing member, a terminal, a wire connected to the terminal and a housing configured to accommodate the terminal and provided with an opening for work, the opening being closed by the opening sealing member, wherein lower end positions of gradients provided on upper surfaces of the cover plate and the plug body are located on an end part opposite to a side where the wire is pulled out.

By discharging water toward the side opposite to the side where the wire is pulled out, the splash of the discharged water on the wire and the like can be suppressed.

Effect

According to the opening sealing member disclosed in this specification, splashed water can be discharged to outside.

EMBODIMENTS OF INVENTION

Embodiment

An embodiment is described with reference to FIGS. 1 to 7.

Figure 5:
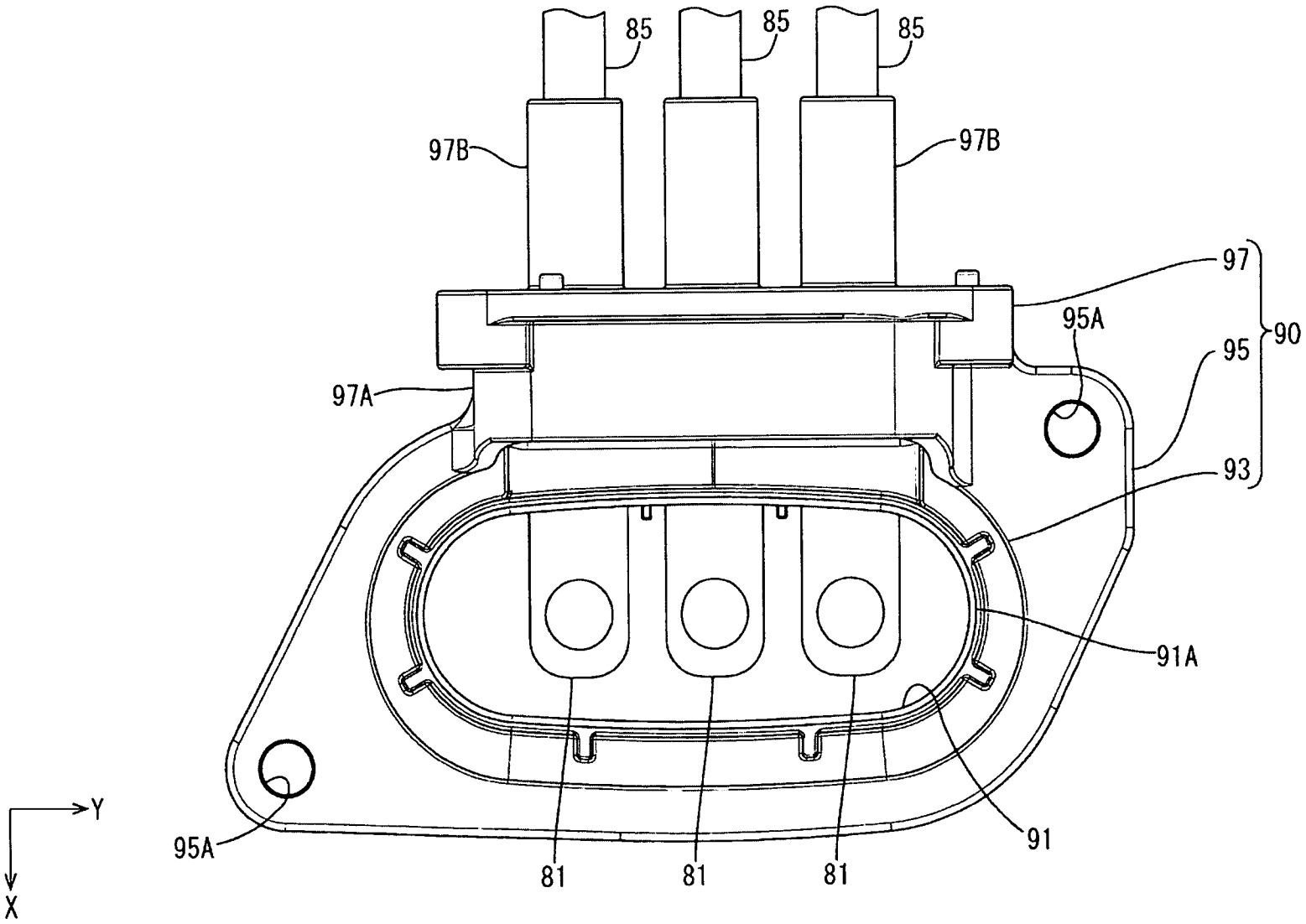
FIG. 5 is a plan view of a connector.
Figure 6:
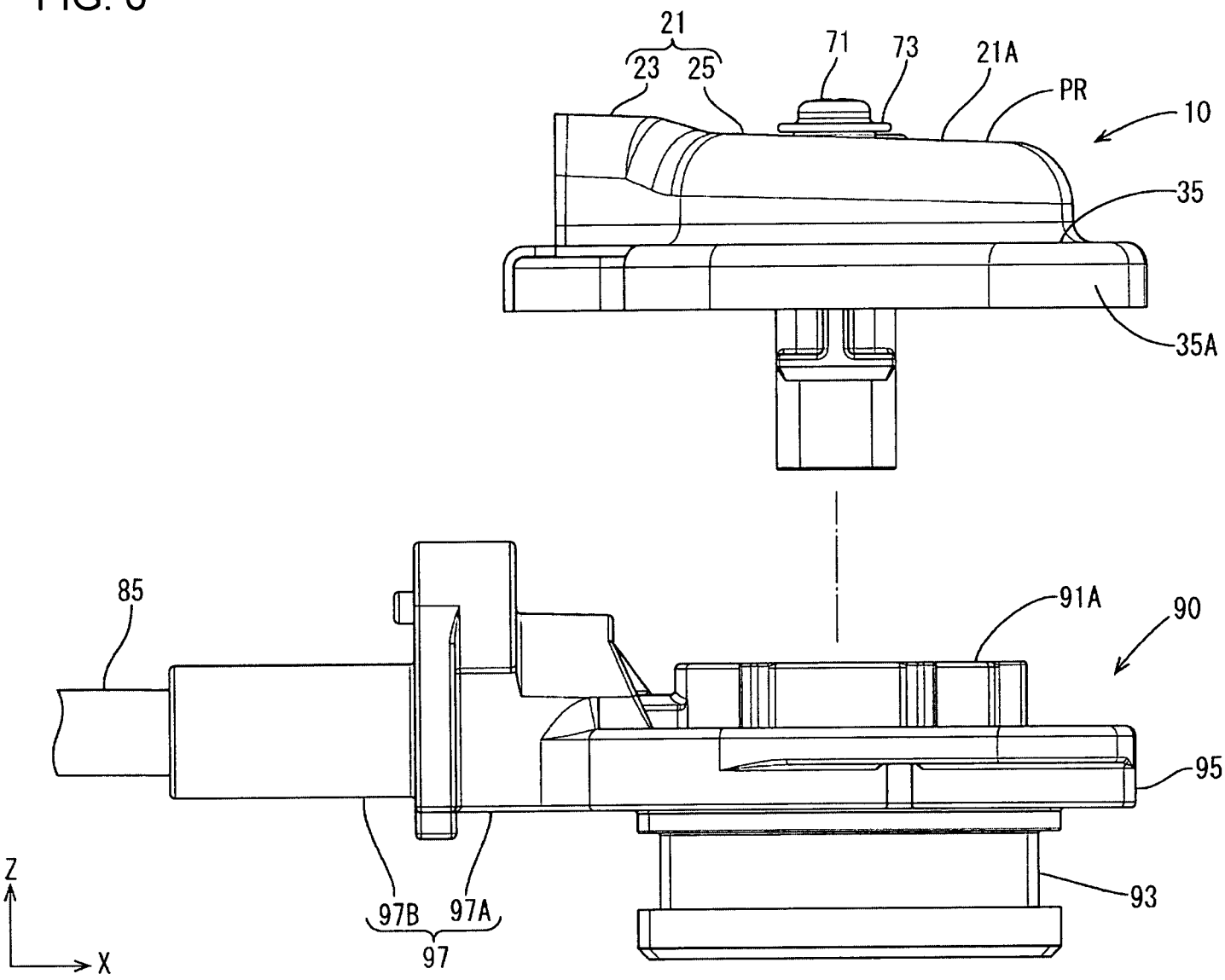
FIG. 6 is a side view in a state before the connector and the opening sealing member are assembled.
Figure 7:
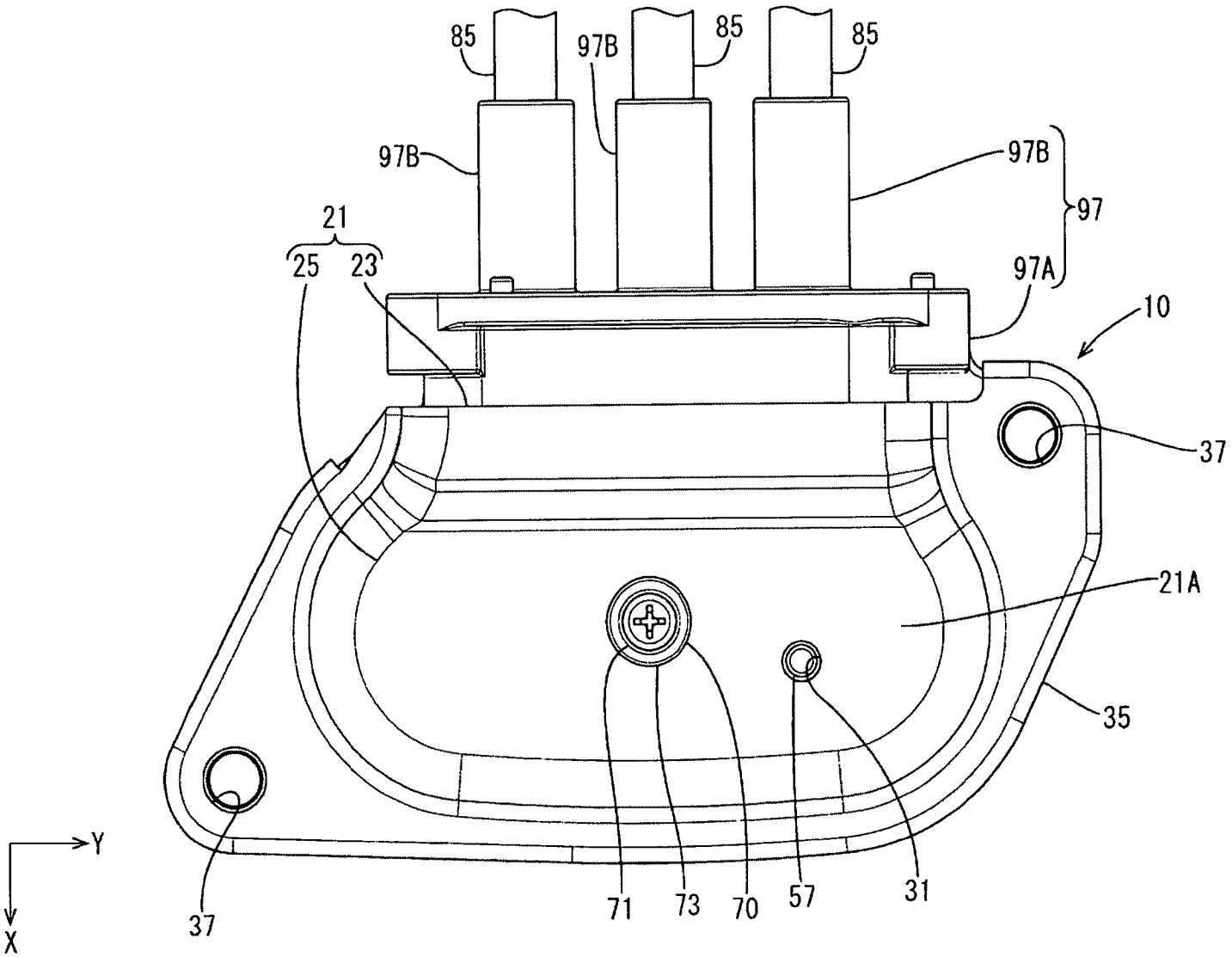
FIG. 7 is a side view in a state after the connector and the opening sealing member are assembled.

An opening sealing member 10 of this embodiment is for closing an opening 91 for work of a connector 80 (an example of an "electrical device") mounted on a shield case of a device such as a motor or inverter installed in a vehicle as shown in FIGS. 5 to 7. In the following description, a Z direction is an upward direction concerning a vertical direction, an X direction is a forward direction concerning a front-rear direction and a Y direction is a rightward direction concerning a lateral direction.

Figure 4:
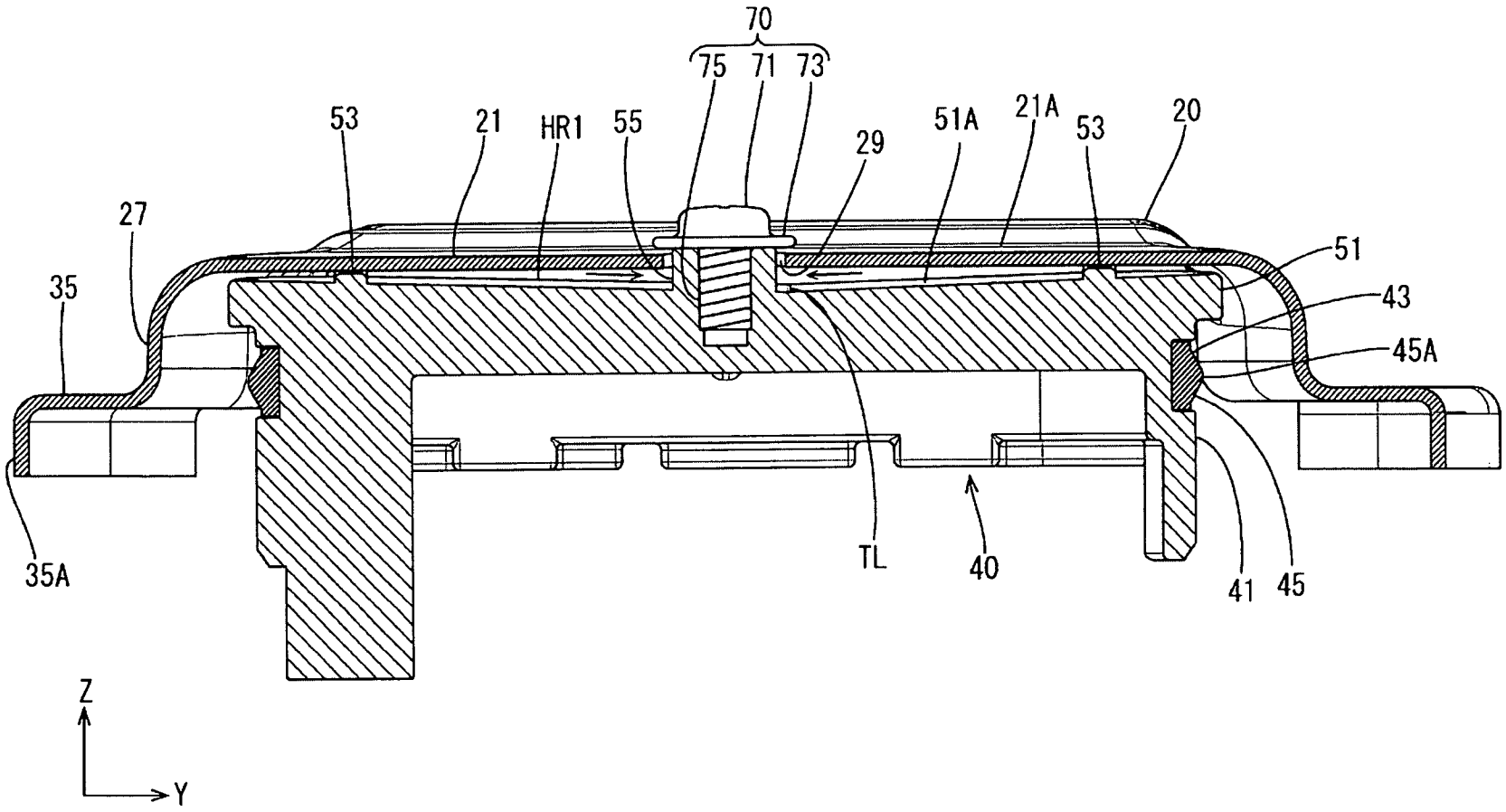
FIG. 4 is a section along IV-IV in FIG. 1.

As shown in FIGS. 4 and 5, the connector 80 is connected to an unillustrated terminal block provided in the shield case. The connector 80 includes terminals 81 made of conductive metal, wires 85 connected to the terminals 81 and a housing 90 made of synthetic resin and accommodating the terminals 81 and end parts of the wires 85.

The terminal 81 is bent into an L shape to extend downward after being connected to the wire 85 and further bent into an L shape in a lower end part of the housing 90 to project into an opening 91 of the housing 90. Three terminals 81 are insert-molded to be arranged in the lateral direction in the housing 90, and connected to mating terminals held on the terminal block.

The housing 90 includes a tubular housing body portion 93 provided with the opening 91, a flange portion 95 in the form of a flat plate projecting outward from the housing body portion 93 and a wire holding portion 97 projecting rearwardly of the housing body portion 93 and configured to hold the wires 85. The opening 91 is open in the vertical direction and has an elliptical shape long in the lateral direction in a plan view. A lower end part of the opening 91 is fit to the terminal block, whereas an operation of connecting the terminals 81 and the mating terminals of the terminal block is performed with the opening 91 open upward. When the connecting operation is not performed, this opening 91 is closed also on an upper side by the opening sealing member 10. Further, the flange portion 95 is provided with bolt insertion holes 95A through which bolts for fixing the shield case and a cover plate 20 of the opening sealing member 10 to be described later are inserted. The wire holding portion 97 includes an integral holding portion 97A for integrally holding connected parts of the terminals 81 and the wires 85 and hollow cylindrical individual holding portions 97B for individually holding the wires 85. The integral holding portion 97A projects further upward than the housing body portion 93. The wires 85 are pulled out rearward from the wire holding portion 97.

Figure 1:
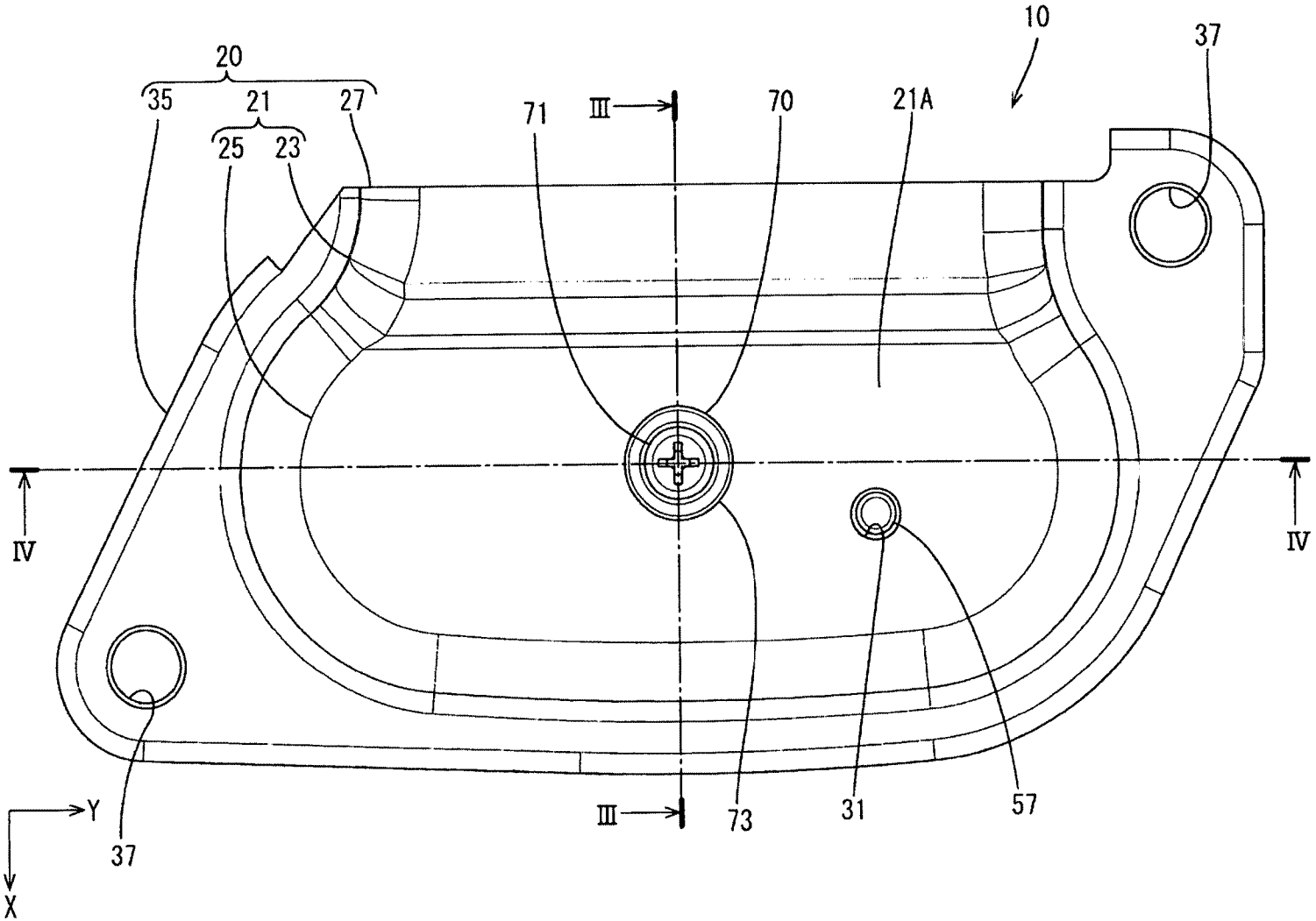
FIG. 1 is a plan view of an opening sealing member in an embodiment.
Figure 3:
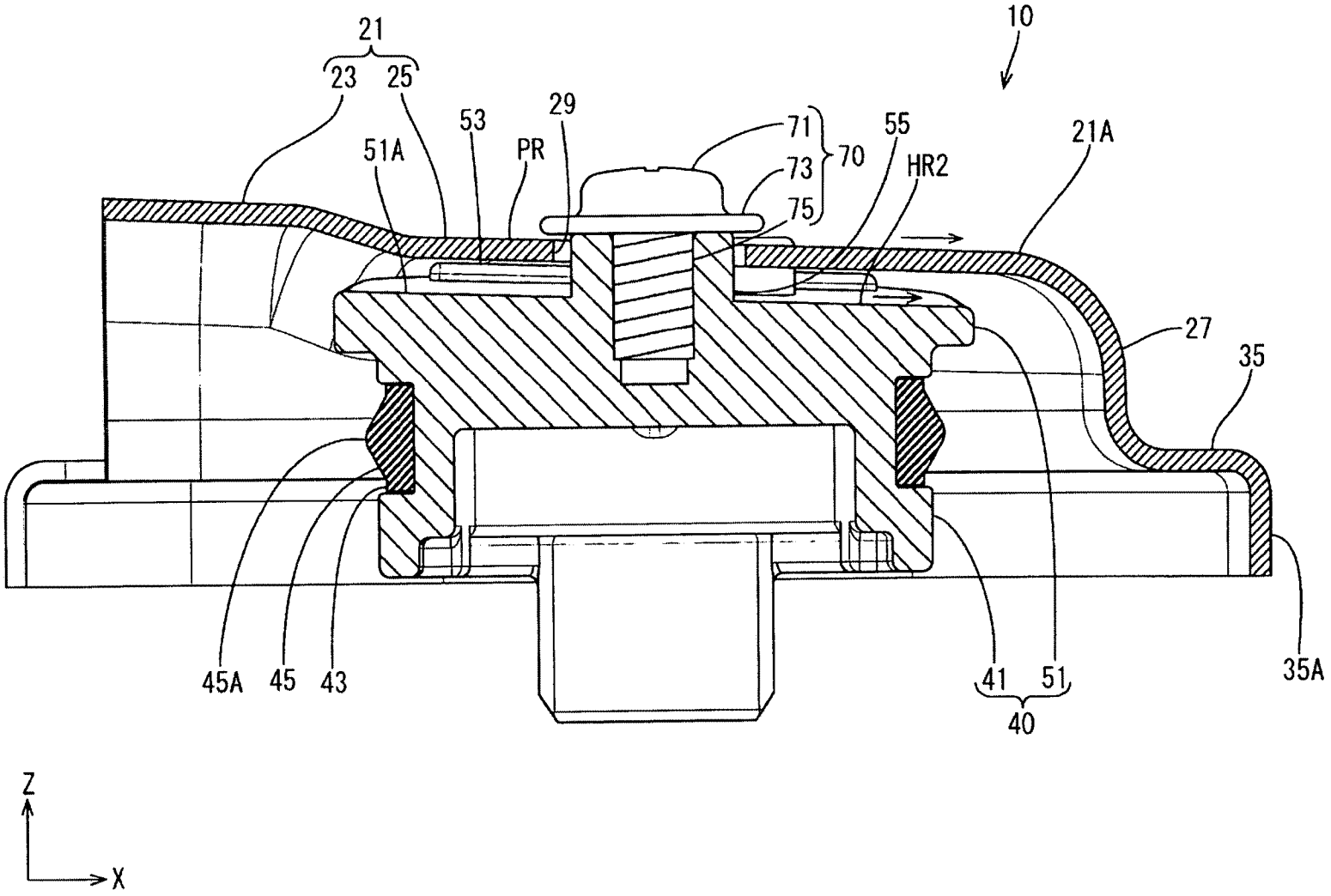
FIG. 3 is a section along in FIG. 1.

As shown in FIGS. 1 and 3, the opening sealing member 10 includes the cover plate 20 and a plug body 40, and the cover plate 20 and the plug body 40 are fixed by a tap screw 70.

The tap screw 70 includes a circular head portion 71, a circular ring portion 73 having a larger diameter than the head portion 71 and a screw portion 75 capable of cutting a thread. An outer diameter of the ring portion 73 is larger than a diameter of an insertion hole 29 of the cover plate 20 to be described later, and the ring portion 73 is retained by being locked to a hole edge part 29A of the insertion hole 29.

Figure 2:
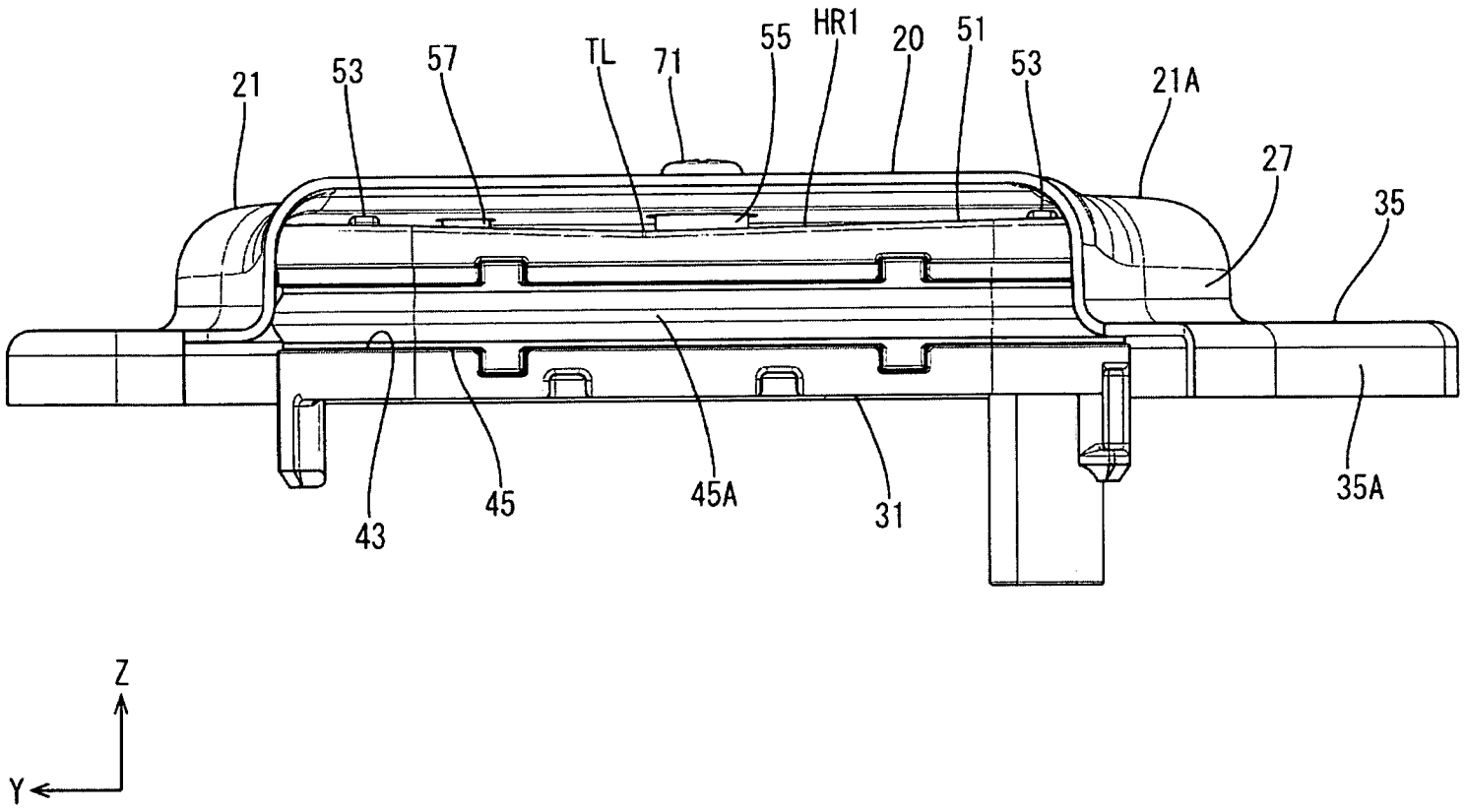
FIG. 2 is a back view of the opening sealing member.

The cover plate 20 is formed by press-working a metal plate such as a steel plate and includes, as shown in FIGS. 1 and 2, a plate body portion 21 for covering the opening 91 and the wire holding portion 97 of the connector 80, a mounting portion 35 for covering the flange portion 95 of the connector 80 and a linking portion 27 for linking an end part of the plate body portion 21 and the mounting portion 35. The linking portion 27 links the plate body portion 21 and the mounting portion 35 by a rounded shape and a vertical surface. The cover plate 20 is in the form of an inverted shallow dish having a rectangular shape and capable of covering the opening 91.

As shown in FIGS. 3 and 6, the plate body portion 21 includes a housing covering portion 23 configured to cover the integral holding portion 97A of the wire holding portion 97 from above and open rearward, and a plug body covering portion 25 for covering the plug body 40. The housing covering portion 23 is open rearward, and a width (lateral dimension) thereof gradually becomes larger toward the front. The plug body covering portion 25 has the same outer shape as the plug body 40 and slightly larger external dimensions than the plug body 40. The circular insertion hole 29 into which a boss portion 55 of the plug body 40 to be described later is insertable is provided in a laterally central part of the plug body covering portion 25. The insertion hole 29 penetrates in a plate thickness direction of the plate body portion 21. Further, the lower surface of the ring portion 73 of the tap screw 70 comes into contact with the hole edge part 29A of the insertion hole 29. Further, a circular pin insertion hole 31 into which a positioning pin 57 of the plug body 40 to be described later is insertable is provided to the right of the insertion hole 29.

An upper surface 21A of the plate body portion 21 is provided with a plate gradient PR so that a rear end is highest and a front end is lowest as a whole. A degree of the plate gradient PR partially differs, but a gradient is constant in the plug body covering portion 25 of the plate body portion 21. Further, the upper surface of the plate body portion 21 is constantly lower on a front side than on a rear side and free from any horizontal part and any recess. Water adhering to the plate body portion 21 flows toward a front side of the plate body portion 21 by the plate gradient PR. The water having reached an end edge of the plate body portion 21 falls along the linking portion 27 and flows down toward the outside of the cover plate 20.

As shown in FIGS. 6 and 7, the mounting portion 35 covers the flange portion 95. The mounting portion 35 has substantially the same outer shape as the flange portion 95 and a side surface 35A of the mounting portion 35 formed by bending an end part of the mounting portion 35 has a vertical dimension equivalent to a plate thickness of the flange portion 95 and completely covers the flange portion 95. The mounting portion 35 is provided with bolt holes 37 concentric with the bolt insertion holes 95A of the flange portion 95.

The plug body 40 is made of synthetic resin and includes, as shown in FIGS. 3 and 4, a fitting portion 41 fittable into the opening 91 (see FIG. 5) and a flat plate portion 51 in the form of a flat plate continuous with an upper end part of the fitting portion 41. The fitting portion 41 has an elliptical shape in a plan view, the outer shape thereof is the same as the inner shape of the opening 91, and outer dimensions thereof are equal to or slightly smaller than inner dimensions of the opening 91. Further, a seal fitting groove 43 is formed over the entire periphery on the outer peripheral surface of the fitting portion 41. A sealing member 45 having an annular elliptical shape is fit in the seal fitting groove 43. One lip 45A projects outward in the sealing member 45, and an outer diameter of the lip 45A is set slightly larger than an inner diameter of the opening 91. When the fitting portion 41 is fit into the opening 91, the lip 45A of the sealing member 45 is squeezed and held in close contact with the inner peripheral surface of the opening 91, thereby sealing between the fitting portion 41 and the opening 91.

The flat plate portion 51 has a laterally long elliptical shape and substantially the same outer shape as the fitting portion 51 and is slightly larger than the fitting portion 41. Outer dimensions of the flat plate portion 51 are larger than the inner dimensions of the opening 91, and the entire flat plate portion 51 is located above the opening 91. The lower surface of the flat plate portion 51 comes into contact with an upper end hole edge part 91A (see FIG. 6) of the opening 91 to position the plug body 40 at a predetermined position of the opening 91. Further, contact portions 53 configured to come into contact with the lower surface of the plate body portion 21 are provided on both longitudinal (lateral) end parts of the flat plate portion 51. The contact portion 53 has a linear shape extending in the front-rear direction and projects upward from the flat plate portion 51. A projecting dimension of the contact portion 53 from the flat plate portion 51 is constant in the front-rear direction.

As shown in FIG. 3, the boss portion 55 is provided to project upward at a center position of the flat plate portion 51. An upper end part of the boss portion 55 is insertable into the insertion hole 29 of the cover plate 20 with a predetermined clearance defined between the hole edge part 29A and this upper end part. A height of the boss portion 55 is set such that the upper end surface of the boss portion 55 slightly projects from a surface of the hole edge part 29A of the insertion hole 29 when the boss portion 55 is inserted into the insertion hole 29. The boss portion 55 has a cylindrical shape and a lower hole into which the tap screw 70 is screwed is provided from the upper surface of the boss portion 55 toward a rear side.

Further, as shown in FIG. 1, the positioning pin 57 in the form of a round pin is formed to project to the right of the boss portion 55 of the flat plate portion 51. The positioning pin 57 is insertable with a predetermined clearance defined between a hole edge part of the pin insertion hole 37 provided in the cover plate 20 and the positioning pin 57. Further, the positioning pin 57 has such a projecting dimension as to slightly project from a surface of the cover plate 20.

As shown in FIGS. 3 and 4, an upper surface MA of the flat plate portion 51 is provided with a first plug body gradient HR1 in a longitudinal direction (lateral direction) of the flat plate portion 51 and a second plug body gradient HR in a transverse direction (front-rear direction). The first plug body gradient HR1 is set such that a right end is highest and a position of a taper end line TL is lowest. The taper end line TL extends straight in the front-rear direction (parallel to an X axis) and is provided to the right of the boss portion 55 (on the side of the positioning pin 57). By providing the first plug body gradient HR1, water adhering to the flat plate portion 51 flows down to be collected at a position to the right of the boss portion 55. Further, the second plug body gradient HR2 is set such that a rear end is highest and a front end is lowest, and about the same as the plate gradient RP of a facing part (plug body covering portion 25) of the plate body portion 21. By providing the second plug body gradient HR2, water adhering to the flat plate portion 51 flows toward a front side of the flat plate portion 51 and the water having reached an end edge of the flat plate portion 51 flows down to the outside of the opening 91. Note that the lower end position of the upper surface MA of the flat plate portion 51 is located above the upper end hole edge part 91A of the opening 91, and water flowing down from the upper surface 51A of the flat plate portion 51 does not intrude into the opening 91.

The opening sealing member 10 of this embodiment is structured as described above and, for example, assembled in the following procedure. First, the sealing member 45 is fit into the seal fitting groove 43 of the plug body 40. Subsequently, the plug body 40 is mounted on a lower side of the plate body portion 21 on the underside (lower surface side) of the cover plate 20. Specifically, the contact portions 53 of the flat plate portion 51 are brought into contact with the underside (lower surface) of the plate body portion 21 while the positioning pin 57 is inserted into the pin insertion hole 31 and the boss portion 55 is inserted into the insertion hole 29. At this time, since the plate gradient PR of the plug body covering portion 25 of the plate body portion 21 and the second plug body gradient HR2 are substantially equal, the underside of the plate body portion 21 and the contact portions 53 are held in contact from the rear ends to the front ends of the contact portions 53.

If the plug body 40 is brought in a proper posture into contact with the underside (rear surface) of the cover plate 20, the tap screw 70 can be fit and tightened into the lower hole of the boss portion 55. At this time, an internal thread can be cut in the lower hole of the boss portion 55 by the screw portion 75 of the tap screw 70. The tap screw 70 is screwed up to a position where the ring portion 73 comes into contact with the upper surface of the boss portion 55. At this time, since the positioning pin 57 of the plug body 40 is fit in the pin insertion hole 31 of the cover plate 20, the plug body 40 is restricted from rotating as the tap screw 70 is screwed.

A drop of the plug body 40 from the underside (rear surface) of the cover plate 20 is hindered by the contact of the ring portion 73 with the hole edge part 29A of the insertion hole 29 and the upper surface of the boss portion 55. Further, the cover plate 20 is mounted movably along an axial direction of the boss portion 55. Further, since the clearances are provided between the boss portion 55 and the insertion hole 29 and between the positioning pin 57 and the pin insertion hole 31, the plug body 40 is held in a state movable in all of upward, downward, leftward and rightward directions.

After the opening sealing member 10 is assembled as described above, the opening sealing member 10 is fit to the opening 91 of the connector 80 as shown in FIG. 6. When the opening sealing member 10 is disposed at a predetermined position and the cover plate 20 is pressed toward the connector 80, the plug body 40 is pushed into the opening 91 while the sealing member 45 is squeezed and deformed in a circumferential direction, and the pushing is stopped when the flat plate portion 51 comes into contact with the upper end hole edge part 91A of the opening 91. At this time, since the plug body 40 is held in the state movable in all the directions, the plug body 40 is fit while being centered with the opening 91. The mounting portion 35 of the cover plate 20 covers the flange portion 95 of the connector 80 and the bolts are inserted through the bolt holes 37 and screwed into the case together with the bolt insertion holes 95A of the connector 80, whereby the opening sealing member 10 is fixed to the upper surface of the case of the device together with the flange portion 95.

It is assumed that water splashes on the opening sealing member 10 with the opening 91 closed by the opening sealing member 10. If the cover plate and the plug body are provided with no gradient, the upper surfaces of the cover plate closing the opening 91 open in the vertical direction and the plug body are horizontal and the water stays thereon. However, in this embodiment, water splashed on the upper surface 21A of the plate body portion 21 of the cover plate 20 flows down toward the front side of the plate body portion 21 by the plate gradient PR. The water having reached the end edge of the plate body portion 21 falls down along the linking portion 27 and flows down to the outside of the cover plate 20. Thus, it can be suppressed that the water adhering to the cover plate 20 stays on the cover plate 20 to corrode the cover plate 20.

Further, water intrudes into a gap between the cover plate 20 and the plug body 40 from a rear opening of the cover plate 20, the insertion hole 29, the pin insertion hole 31 and the like. The intruding water flows toward the front side of the flat plate portion 51 by the second plug body gradient HR2 while being collected toward the taper end line TL by the first plug body gradient HR1 on the upper surface 51A of the flat plate portion 51 of the plug body 40. At this time, since the taper end line TL and the boss portion 55 are shifted in position in the longitudinal direction, the boss portion 55 does not stand as a hindrance when the water collected toward the taper end line TL flows down toward the front side. Note that since the taper end line TL is located on the side of the boss portion 55 toward the positioning pin 57, a gradient on the side of the positioning pin 57 becomes steep and the water easily flows even if the positioning pin 57 is present. The water having reached the end edge of the flat plate portion 51 is caused to flow down to the outside of the opening 91 by two types of the plug body gradients HR1, HR2. At this time, the lower end position of the upper surface 51A of the flat plate portion 51 is located above the upper end hole edge part 91A of the opening 91 and the water flowing down from the upper surface 51A of the flat plate portion 51 does not intrude into the opening 91. Since the water intruding between the plug body 40 and the cover plate 20 is also discharged, the corrosion of the cover plate 20 and the intrusion of the water into the opening 91 can also be suppressed.

As just described, water splashed on the upper surface 21A of the plate body portion 21 of the cover plate 20 and water intruding between the cover plate 20 and the plug body 40 finally flow down toward the front side of the opening sealing member 10. Thus, it is sufficient to deal with the flowing-down water only on the front side. Further, since the water is caused to flow down toward the front side, the splash of the water on the wires 85 extending rearward can be suppressed.

In this embodiment, water splashed on the cover plate 20 flows down from the cover plate 20 and does not stay on the cover plate 20 since the upper surface 21A of the plate body portion 21 of the cover plate 20 is provided with the plate gradient PR. Further, since the water intruding between the cover plate 20 and the plug body 40 is also caused to flow down from the plug body 40 to the outside of the opening 91 by providing the plug body 40 with the plug body gradients HR1, HR2, the water does not stay between the plug body 40 and the cover plate 20. Therefore, corrosion by the intruding water can be suppressed.

Other Embodiments

The technique disclosed by this specification is not limited to the above described and illustrated embodiment. For example, the following various modes are also included.

(1) Although the plate gradient PR of the cover plate 20 is set such that the rear end is highest and the front end is lowest in the above embodiment, the plate gradient PR may be conversely set or provided in the longitudinal direction. Further, the plate gradient PR may be such a gradient as to be high in a central part and become lower toward edge parts.

(2) Although the first plug body gradient HR1 of the plug body 40 is set such that both ends are high and the taper end line TL is low in the above embodiment, the first plug body gradient HR1 may be such a gradient as to be high in a central part and become lower toward edge parts. Further, the taper end line TL is provided on the side of the boss portion 55 toward the positioning pin 57, but may be provided on an opposite side or may overlap with the boss portion 55. Although the second plug body gradient HR2 of the plug body 40 is set such that the rear end is high and the front end is low, the second plug body gradient HR2 may be conversely set. Further, the second plug body gradient HR2 may be such a gradient as to be high in a central part and become lower toward edge parts. Furthermore, only either one of the first plug body gradient HR1 and the second plug body gradient HR2 may be provided.

(3) Although the mounting portion 35 is provided with no gradient in the above embodiment, the flange portion 95 and the mounting portion 35 may be provided with gradients.

(4) Although the mounting portion 35 covers the entire flange portion 95 in the above embodiment, the mounting portion 35 may be provided only at the position of the bolt insertion hole 95A.

(5) Although the plate gradient PR of the cover plate 20 and the second plug body gradient HR2 of the plug body 40 are in the same direction and have the same angle in the facing parts in the above embodiment, these gradients may be in different directions and may have different angles in the facing parts.

(6) Although water is caused to flow toward a side opposite to the side where the wires 85 extend in the above embodiment, the water flowing side may not be the opposite side.

(7) Although the opening 91 is provided in the housing 90 of the connector 80 in the above embodiment, the opening 91 may be provided in the metal case or the like.

(8) Although the flat plate portion 51 having larger external dimensions than the fitting portion 41 is provided in the above embodiment, the outer diameter of the flat plate portion may be equal to or smaller than that of the fitting portion 41. It is sufficient that the lower end position of the upper surface of the plug body is located above the upper end surface of the opening 91.

10 opening sealing member
20 cover plate
21 plate body portion
21A upper surface
29 insertion hole
31 pin insertion hole
35 mounting portion
40 plug body
41 fitting portion
51 flat plate portion
51A upper surface
55 boss portion
57 positioning pin
70 tap screw
80 connector (electrical device)
81 terminal
85 wire

90 housing
91 opening
PR plate gradient
HR1 first plug body gradient
HR2 second plug body gradient
TL taper end line

The invention claimed is:

1. An opening sealing member for closing an opening for work open in a vertical direction, comprising:

a cover plate configured to cover the opening from above; and a plug body held on the cover plate and including a sealing member to be held in close contact with an inner peripheral surface of the opening by the plug body being fit into the opening;

wherein:

an upper surface of the cover plate is provided with a gradient to cause water adhering to the cover plate to flow down to outside of the cover plate; and an upper surface of the plug body is provided with a gradient to cause water adhering to the upper surface of the plug body to flow down to outside of the opening.

2. The opening sealing member of claim 1, wherein the upper surface of the cover plate and the upper surface of the plug body are provided with the gradients in the same direction.

3. The opening sealing member of claim 1, wherein a boss used to screw a bolt for fixing the plug body to the cover plate is provided to project on the plug body;

the plug body has an elliptical shape in a plan view and the upper surface of the plug body is provided with a first plug body gradient in a longitudinal direction and a second plug body gradient in a transverse direction; and a lower end position of the first plug body gradient is shifted in the longitudinal direction from a position where the boss portion is provided.

4. An electrical device, comprising:

the opening sealing member of claim 1;

a terminal;

a wire connected to the terminal; and a housing configured to accommodate the terminal and provided with an opening for work, the opening being closed by the opening sealing member;

wherein lower end positions of gradients provided on upper surfaces of the cover plate and the plug body are located on an end part opposite to a side where the wire is pulled out.

* * * * *